US009779594B2

(12) United States Patent
Rigdon et al.

(10) Patent No.: US 9,779,594 B2
(45) Date of Patent: Oct. 3, 2017

(54) ESTIMATING VESSEL INTENT

(71) Applicant: The Boeing Company, Chicago, IL (US)

(72) Inventors: Debra A. Rigdon, Kent, WA (US); Timothy A. Tibbetts, Renton, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/825,692

(22) Filed: Aug. 13, 2015

(65) Prior Publication Data

US 2017/0043848 A1 Feb. 16, 2017

(51) Int. Cl.

| | |
|---|---|
| ***G08B 23/00*** | (2006.01) |
| ***G08B 13/00*** | (2006.01) |
| ***B63B 69/00*** | (2013.01) |
| ***G08G 3/02*** | (2006.01) |
| *B63J 99/00* | (2009.01) |

(52) U.S. Cl.

CPC ..... *G08B 13/00* (2013.01); *B63B 69/00* (2013.01); *G08G 3/02* (2013.01); *B63J 2099/006* (2013.01)

(58) Field of Classification Search

CPC ..... H02J 5/005; H02J 7/025; H02J 17/00

USPC ..... 340/984, 541, 989; 342/41, 352; 348/148; 370/326; 701/21, 300; 714/724, 799

See application file for complete search history.

(56) References Cited

U.S. PATENT DOCUMENTS

| | | | | |
|---|---|---|---|---|
| 7,817,079 | B1 * | 10/2010 | Funk | G01S 7/003 342/41 |
| 9,015,567 | B2 * | 4/2015 | Peach | G06F 11/0751 714/799 |
| 2009/0207020 | A1 * | 8/2009 | Garnier | G08B 21/12 340/541 |
| 2011/0215948 | A1 * | 9/2011 | Borgerson | G06Q 10/08 340/989 |
| 2013/0275842 | A1 * | 10/2013 | Peach | G06F 11/0751 714/799 |
| 2016/0363671 | A1 * | 12/2016 | Anderson | G01C 21/203 |

OTHER PUBLICATIONS

Maritime Anomaly Detection: Domain Introduction and Review of Selected Literature; Defence R&D Canada—Valcartier, Technical Memorandum, DRDC Valcartier TM 2010-460, Oct. 2011, (66 pgs).

"Detection of malicious AIS position spoofing by exploiting radar information", Information Fusion (Fusion), 2013 16th International Conference, IEEE, Jul. 9-12, 2013, pp. 1196-1203.

"Learning Abnormal Vessel Behaviour form AIS Data with Bayesian Networks at Two Time Scales," Tracks a Journal of Artists Writings, Aug. 31, 2010, 34 pages.

* cited by examiner

*Primary Examiner* — Dhaval Patel

(74) *Attorney, Agent, or Firm* — Toler Law Group, PC

(57) ABSTRACT

A computer implemented method includes receiving maritime vessel automatic identification system (AIS) data from a vessel. The method includes determining that the maritime vessel AIS data includes anomalous data. The method also includes estimating a likelihood of malicious vessel intent based on a comparison of the anomalous data to secondary data. In response to the likelihood of malicious vessel intent satisfying a threshold, the method further includes generating an alert that includes an indication of an inferred intent for the vessel.

22 Claims, 4 Drawing Sheets

ESTIMATING VESSEL INTENT

FIELD OF THE DISCLOSURE

The present disclosure is generally related to estimating vessel intent.

BACKGROUND

There is a tremendous amount of shipping activity that occurs every day across the globe. It may be difficult to monitor and to effectively evaluate all of the shipping activity to recognize potential problems, such as smuggling operations, terrorist threats, etc. Vessels of a certain type and/or size broadcast automatic identification system (AIS) data that includes vessel position information and other identifying information. The AIS system is a wide-spread, transponder-based system for identifying vessels at a distance. Unfortunately, a significant number of vessels broadcast anomalous data, and it is not practical for all anomalous data to be evaluated in real time by an analyst (or for all vessels broadcasting anomalous data to be intercepted by a coast guard vessel for further investigation).

SUMMARY

In a particular embodiment, a computer implemented method includes receiving maritime vessel automatic identification system (AIS) data from a vessel. The method includes determining that the maritime vessel AIS data includes anomalous data. The method also includes estimating a likelihood of malicious vessel intent based on a comparison of the anomalous data to secondary data. In response to the likelihood of malicious vessel intent satisfying a threshold, the method further includes generating an alert that includes an indication of an inferred intent for the vessel.

In another particular embodiment, a computer-readable storage medium stores instructions that, when executed by a processor, cause the processor to perform various operations. The operations include receiving maritime vessel AIS data from a vessel. The operations include determining that the maritime vessel AIS data includes anomalous data and estimating a likelihood of malicious vessel intent based on a comparison of the anomalous data to secondary data. The operations further include, in response to the likelihood of malicious vessel intent satisfying a threshold, generating an alert that includes an indication of an inferred intent for the vessel.

In another particular embodiment, a system includes a processor and a memory in communication with the processor. The memory includes instructions that are executable by the processor to perform various operations. The operations include receiving maritime vessel AIS data from a vessel. The operations include determining that the maritime vessel AIS data includes anomalous data and estimating a likelihood of malicious vessel intent based on a comparison of the anomalous data to secondary data. The operations further include, in response to the likelihood of malicious vessel intent satisfying a threshold, generating an alert that includes an indication of an inferred intent for the vessel.

The features, functions, and advantages that have been described can be achieved independently in various embodiments or may be combined in other embodiments, further details of which are disclosed with reference to the following description and drawings.

DETAILED DESCRIPTION

Figure 1:
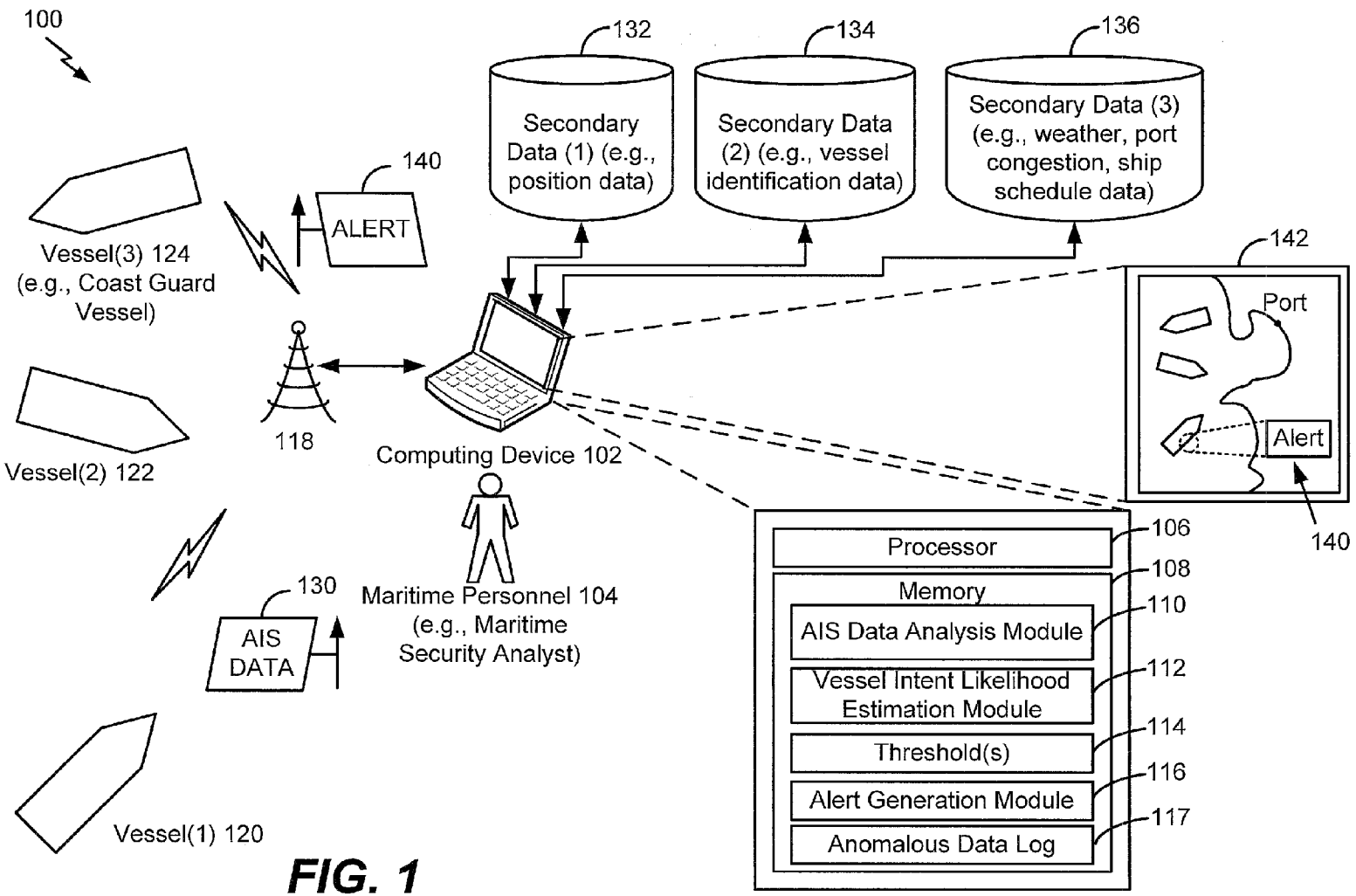
FIG. 1 is a diagram illustrating a maritime security system, according to one embodiment.

The present disclosure relates to systems and methods of evaluating information that is broadcast by a vessel (e.g., AIS data) and performing an automated analysis that mimics human-like reasoning to determine if the vessel is a "problem" vessel or if problems found with the data have an innocent explanation such as "sloppy" maintenance of AIS transceiver data. Identifying vessels that are more likely to represent "problem" vessels may allow maritime security analysts and coast guard personnel to focus on vessels that are most likely to represent a potential threat, potentially providing improved maritime/coastal security. A likelihood of malicious vessel intent may be estimated through the application of heuristic, logical, and numerical algorithmic techniques. To illustrate, a set of hypotheses may be generated regarding a vessel's intent, and the set of hypotheses may be narrowed based on a preponderance of the evidence.

In the present disclosure, AIS data that is received from a vessel (e.g., a ship) may be evaluated to determine whether information provided by the transmitter (vessel) is incorrect. Incorrect information may include incorrect position information or other information, such as incorrect identifying data or trip information. When incorrect information is detected, an analysis is performed to determine whether the vessel should be "flagged" for further attention (e.g., by an analyst or the coast guard).

In some cases, AIS data may be incorrect as a result of inattention or a lack of knowledge by a user. In other cases, the AIS data may be incorrect because the user has made adjustments in an attempt to spoof or deceive receiving parties, allowing the user to proceed with illegal or terrorist activities without discovery.

The present disclosure describes the application of a series of algorithms to broadcast AIS data in order to allow detection of anomalies and to provide correlation of the broadcast AIS data with other sources of data, including open source, commercial, and historical data. The evaluation may not require "pre-cleaned" or validated data to correct problems such as typographical errors and/or incomplete vessel names/identifying numbers and/or missing data and/or erroneous data. Algorithms are embedded in this evaluation that account for many of these issues. Further, since the subsequent multi-hypothesis evaluations making use of the data from these sources are based on a preponderance of evidence, it is not necessary for this data to be perfect since it is merely determining if there is at least a reasonable cause for additional investigation. In addition, the evaluation is entirely automated, requiring no human setup or intervention (unless or until an alert is generated).

The first step is detecting incorrect information. For position data, a second source of position information may be used to validate AIS position data received from a vessel. The AIS position data is also evaluated for "reasonableness" or "unreasonableness," such as a deviation from an expected vessel location that exceeds a threshold distance or the position being associated with a location on land or in non-navigable waters. If the vessel is not located at an expected location (within a degree of reasonableness), information regarding weather delays, port congestion, or shipper schedule updates may be evaluated to determine if there is an explanation for the deviation from the expected location. If no reasonable explanation can be found for the deviation, then the deviation may be flagged as an anomaly (referred to herein as a "vessel position anomaly").

Other information (from the AIS data) that can be incorrect is the AIS identifying data broadcast by a vessel. When errors in AIS identifying data are identified, an attempt is made to determine the correct information and to determine an explanation for the incorrect information. Correct information may be retrieved from reliable sources of vessel information, and then an automated analysis is performed to determine a possible explanation for the error. This analysis may also make use of historical data. A history of erroneous information for a vessel, crew or shipping company may be a useful indicator to infer vessel intent. In addition, there may also be common patterns of errors and/or behavior that may be useful for determining explanations for the errors.

There can also be errors in AIS trip data that is broadcast by a vessel. In some cases, such errors are a result of the crew being slow to update the trip information. Historical patterns of behavior can be useful for evaluating these errors. Other sources of information such as the ship's voyage details or schedule can also be used to determine if vessel movement matches expectations (independent of the AIS trip data).

The system of the present disclosure not only provides alerts based on suspicious AIS broadcasters, but also provides an indication (or categorization) of likely vessel intent. For example, many people (often recreational boaters) leave AIS transmitters on default settings. Others embed special messages or additional data outside the AIS specification. Thus, analysis of the AIS data without the use of secondary data may allow for a determination of whether the AIS data is consistent with the vessel that is broadcasting the AIS data. If additional data is available (e.g., from public domain sources on the Internet), additional analysis can be performed to determine whether the vessel (and AIS number) matches patterns associated with specific types of data. As an illustrative example, smuggling often involves frequent ownership changes of a vessel. As another illustrative example, terrorism often involves one vessel masquerading as another vessel. In such cases, intent may be inferred at least broadly, and data that supports the inferred intent may be provided to a human operator to allow determination of whether to forward the alert to higher authorities or to take action. The automated process described herein also eliminates numerous vessels with AIS data errors that were merely distractions rather than real security threats.

The automated evaluation/analysis of the present disclosure may not require exhaustive, universal data. Rather, the system of the present disclosure may operate within a region (or globally). Similarly, the system of the present disclosure does not require historical AIS data or manual intervention to clean/input such data. The evaluation of whether anomalous data is likely to represent malicious vessel intent may utilize an available subset of data, and the evaluation does not require complete voyage data, or even data from all vessels in an area.

Illustrative examples of AIS data evaluations include identifying correlation of data from multiple sources. The AIS data evaluations may also take into account the quality/fidelity of a source of data, including use of historical performance of the data source. Multiple concurrent hypotheses may be maintained, and queries may be generated to validate/invalidate each individual hypothesis. Each data anomaly may be analyzed (e.g., variations in speed may imply many filings). The present disclosure incorporates mechanisms to increase/decrease "belief" in a particular hypothesis.

In the present disclosure, a vessel's history (and/or an entity associated with the vessel, such as a country, organization or person) may be evaluated with respect to current actions of the vessel. As illustrative examples of historical evaluations, a ship that historically serves African coastal communities may change a geographical area of operations or a type of cargo carried, a freighter that does not historically carry passengers may carry passengers, or a crew size composition may change relative to historical crew information for a vessel, among other alternatives. Examples of a deviation from normal behavior may include a ship that runs with larger or smaller crews than normal, or a ship working a given route working "opposite" to a normal direction, among other alternatives. Further, an associated entity's intent and recent actions may be evaluated (e.g., Country X has been discovered trying to smuggle Y multiple times in the past, etc.).

Other examples of evaluations include evaluating written material, reports or evaluating intelligence analysis for intent represented within documents. Consistency among available documentation may also be evaluated (e.g., comparing loading manifests between what is reported by associated entities, what is reported by ports, what is reported by transfer carriers, etc.). In some cases, multiple types of cargo may form a risk when associated (e.g., a single vessel transporting items which, while not dangerous by themselves, when combined can be dangerous, such as fertilizer and fuel oil, hardware that can serve dual purposes, etc.). More than one ship may be evaluated to identify affiliated vessels/entities that are converging geographically/chronologically (e.g., each one potentially bearing a component of a weapon, components of an illegal technical operation, etc.).

In some cases, complete analysis reports may be provided for a suspect entity, not just a number/score (e.g., ship X is believed to constitute a risk because it has a history of smuggling operations, four members of the crew have been previously convicted of smuggling operations, the pattern of ports visited follows a known, common smuggling pattern, etc.). An evaluation may incorporate known conditions in the relevant areas (e.g., when country X is being blockaded, look for ships that may be spoofing AIS data and/or paperwork). An evaluation may look for innocuous explanations of AIS data anomalies that at first seem suspicious. As an example, a ship trolling back and forth in one location could be waiting for a rendezvous, or the ship could be fishing, hosting divers, etc. As another example, a ship following a circuitous route and/or varying speed outside of normal speeds could be engaged in hostile activity, or the ship could have mechanical troubles (based on historical data), or the ship could be avoiding weather or pirates, etc.

Referring to FIG. 1, a diagram 100 illustrates a particular embodiment of a maritime security system. In FIG. 1, multiple maritime vessels are illustrated to show that, in some cases, anomalous AIS data may indicate that a first vessel represents a threat to another vessel (e.g., AIS spoofing by pirates). FIG. 1 further illustrates that, upon determining that anomalous AIS data has a high likelihood of representing an actual threat, an alert may be sent to one or more security personnel (e.g., port security personnel) and/or coast guard personnel. Identifying particular anomalous AIS data that is more likely to represent an actual threat than other anomalous AIS data may allow authorized personnel to more efficiently focus their threat prevention/mitigation efforts.

In the particular embodiment illustrated in FIG. 1, a computing device 102 is associated with, assigned to, or accessed by one or more maritime personnel 104 (e.g., a maritime security analyst). The computing device 102 includes a processor 106 and a memory 108 in communication with the processor 106. The memory 108 stores instructions that are executable by the processor 106 to perform various operations. In the illustrative example of FIG. 1, the memory 108 includes an AIS data comparison module 110, a vessel intent likelihood estimation module 112, a threshold 114 (or multiple thresholds), and an alert generation module 116.

FIG. 1 further illustrates that the computing device 102 may be configured to communicate with one or more maritime vessels (e.g., via a transceiver 118). For illustrative purposes only, FIG. 1 shows an example of a first vessel 120, a second vessel 122, and a third vessel 124. It will be appreciated that an alternative number of vessels may communicate data to the computing device 102. FIG. 1 illustrates that the first vessel 120 may transmit maritime vessel AIS data 130 (referred to herein in "AIS data") via a broadcast transmission to the computing device 102. The AIS data 130 may include AIS position data, AIS identifying data, AIS trip data, or a combination thereof. Some types of AIS data may be particularly indicative of a potential threat, such as AIS spoofing (e.g., faking a Maritime Mobile Service Identity (MMSI), a current location, etc.) or not broadcasting AIS data. Such behavior may represent examples of anomalous data with a high likelihood of being associated with potential threat/hostile intent. By contrast, using default values, using "cute" values, "off by 1" MMSI numbers, and empty fields may have a low likelihood of representing a potential threat/hostile intent.

The computing device 102 is configured to receive the AIS data 130. FIG. 1 illustrates that one or more sources of secondary data may be accessible to the computing device 102. For example, a first secondary data source 132 may include secondary position data, a second secondary data source 134 may include secondary vessel identification data, and a third secondary data source 136 may include weather data, port congestion data, shipper schedule data, or a combination thereof (among other alternatives). To illustrate, bad weather may explain a transit delay, a route anomaly (e.g., leaving a standard shipping route to avoid a storm), a change in itinerary (e.g., change order of arrival at ports when a multi-port route is involved, which may be applicable for particular types of vessels and cargoes).

The computing device 102 is configured to determine whether the AIS data 130 includes anomalous data and to estimate a likelihood of malicious vessel intent based on a comparison of the anomalous data to secondary data (e.g., data stored at one or more of the secondary data sources 132-136). FIG. 1 illustrates that, in response to the likelihood of malicious vessel intent satisfying the threshold 114, the computing device 102 is configured to generate an alert 140. While not shown in the example of FIG. 1, the alert 140 may include an indication of an inferred intent for the first vessel 120. In the particular embodiment illustrated in FIG. 1, the alert 140 is sent to the third vessel 124 (e.g., a coast guard vessel) and is sent to a display device for display via a graphical user interface 142. In other cases, the alert 140 may sent to other devices/vessels (e.g., as an email message, an automated phone call, a text message, etc.).

As an example, the likelihood of malicious vessel intent may correspond to a likelihood of an AIS spoofing attempt, an AIS hijacking attempt, or an AIS availability disruption attempt. An AIS disruption event may be a transmitter failure, or the transmitter may have been turned off to conceal a vessel's location. In some cases, turning off the transmitter is not malicious because fishing vessels do this as a regular practice to conceal the locations of their best fishing spots. In other cases, turning off the transmitter may be malicious (e.g., to conceal a smuggling operation). The threshold(s) 114 stored at the memory 108 of the computing device 102 may include a first threshold associated with an AIS spoofing attempt, a second threshold associated with an AIS hijacking attempt, or a third threshold associated with an AIS availability disruption attempt (or a combination thereof, among other alternatives).

In some cases, the computing device 102 may send the alert 140 to a first device associated with a maritime security analyst, to a second device associated with coast guard personnel, or a combination thereof. The computing device 102 may refrain from generating the alert 140 in response to the likelihood of malicious vessel intent failing to satisfy the threshold 114. The threshold 114 may be a user adjustable threshold, allowing a user to determine what level of alert that the user is prepared to handle. If the user is receiving too many alerts to handle, the user may raise the threshold 114. If the user is receiving too few alerts, the user may lower the threshold 114. For purposes of operator display, since the likelihood the vessel is a problem is the value used in the alert thresholding, the vessels are stacked in this order so that the vessels most likely to be a problem are at the top of the queue.

The indication of the inferred intent may identify a particular category of anomalous behavior of a plurality of categories of anomalous behavior. As illustrative, non-limiting examples, the particular category of anomalous behavior may correspond to a vessel position anomaly category, a vessel identity anomaly category, or a vessel trip anomaly category. While algorithms to determine position anomalies (kinematic) may not be utilized to determine identity anomalies, one way that a vessel may be flagged as a vessel identity anomaly is a result of the data indicating that the vessel is located in two or more places at the same time. Similarly, position anomalies may overlap with trip anomalies (related to unusual paths chosen by a given vessel within a given purpose).

As an example, the AIS data 130 may include AIS position data, and the computing device 102 may determine that a vessel position anomaly is associated with the first vessel 120 based on a comparison of the AIS position data to secondary position data (e.g., stored at the first secondary data source 132). In some cases, the vessel position anomaly may indicate a deviation of the first vessel 120 from a shipping route. In other cases, the vessel position anomaly may indicate that the AIS position data is associated with a location on land or in non-navigable waters. Using a preponderance of evidence approach, the likelihood of malicious vessel intent increases with more problem data. Explanations for particular problems may lower the likelihood, such as a late port arrival being explained by bad weather.

As another example, the AIS data 130 may include AIS identifying data, and the computing device 102 may determine that a vessel identity anomaly is associated with the first vessel 120 based on a comparison of the AIS identifying data to secondary vessel identity data (e.g., stored at the second secondary data source 134). In some cases, the secondary vessel identity data may include a plurality of Maritime MMSI numbers, and the vessel identity anomaly is indicative of an incorrect MMSI number. In this case, the threshold 114 may correspond to a true/false for an incorrect MMSI number. In other cases, the secondary vessel identity data may include a plurality of International Maritime Organization (IMO) ship identification numbers, and the vessel identity anomaly may be indicative of an incorrect IMO ship identification number. In this case, the threshold 114 may correspond to a true/false for an incorrect IMO ship identification number. Alternatively, a continuous scale may be applied indicating how close the MMSI or IMO numbers are to the expected number, given the quality of agreement between other identifying parameters (e.g., while the MMSI or IMO number may only a 90% match with the expected number, if all other parameters provide a high confidence match, then this is likely a typographical error.)

An incorrect MMSI number or IMO ship identification number may be included in the evidence that indicates bad intent. Without an innocent explanation, such an anomaly may substantially increase a likelihood of malicious intent, as such errors require an explanation or should be identified as a matter of high concern. An example of an innocent explanation is a local shipping company, and the company may move AIS transmitters between vessels in their fleet. Such behavior is not acceptable, as the MMSI value in the radio is assigned to a particular vessel. The local shipping company should change the MMSI setting in the radio when switching to another vessel, but they may be sloppy. While such behavior is unacceptable and may be in violation of state/local/national regulations, such behavior is not indicative of malicious intent. A single incorrect MMSI number report may not be enough to trigger an alert. Other information beyond the MMSI and IMO numbers may be evaluated. For example, each of the AIS broadcast data fields may be compared to historically-recorded AIS records for this (or possibly similar/duplicate) vessel(s), as well as checked against manifest data and other types of records (e.g., from Coast Guard sources, etc.).

As a further example, the AIS data 130 may include AIS trip data, and the computing device 102 may determine that a vessel trip anomaly is associated with the first vessel 120 based on a comparison of the AIS trip data to secondary vessel trip data (e.g., stored at the third secondary data source 136). In some cases, the AIS trip data may include an estimated time of arrival (ETA) at a destination (e.g., a port as illustrated in the graphical user interface 142), and the vessel trip anomaly may be indicative of a deviation of the estimated ETA at the destination from an expected ETA at the destination (within an acceptable expected ETA deviation threshold).

As an illustrative, non-limiting example of an "innocuous" AIS identifying information anomaly, when the anomalous data includes a vessel name typographical error, the vessel intent likelihood estimation module 112 may determine that the likelihood of malicious vessel intent that is associated with the vessel name typographical error does not satisfy the threshold 114. As another example, when the anomalous data includes an IMO ship identification number typographical error, the vessel intent likelihood estimation module 112 may determine that the likelihood of malicious vessel intent that is associated with the IMO ship identification number typographical error does not satisfy the threshold 114. To identify typographical errors, various algorithms may be utilized for comparison of strings (e.g., identifiers of entities that are alphanumeric in nature, such as names) of different types. An example of an innocuous typographical error may include one digit wrong, two digits transposed, interchange of the letter "O" and a zero, etc. Multiple comparisons of the two strings may be performed to determine an estimated likelihood that the numbers/characters are the same. The threshold 114 that is applied to this likelihood may depend on the type of data, the source, and may be used in conjunction with other information (e.g., if the MMSI number of very similar to a known MMSI but other factors are different). As an illustrative example, when one MMSI number is associated with a tanker ship and another MMSI number is associated with a pleasure craft, this may reduce the likelihood that the two vessels are the same.

Thus, FIG. 1 illustrates an example of a maritime security system that may selectively generate alert(s) based on a likelihood of malicious vessel intent. By utilizing secondary data for comparison to anomalous AIS data that is received from a vessel, anomalous data that is more likely to represent an actual threat may be identified. Filtering the anomalous data may allow maritime personnel to effectively utilize limited resources for security operations (e.g., inspection/boarding/interception of a vessel).

Figure 2:
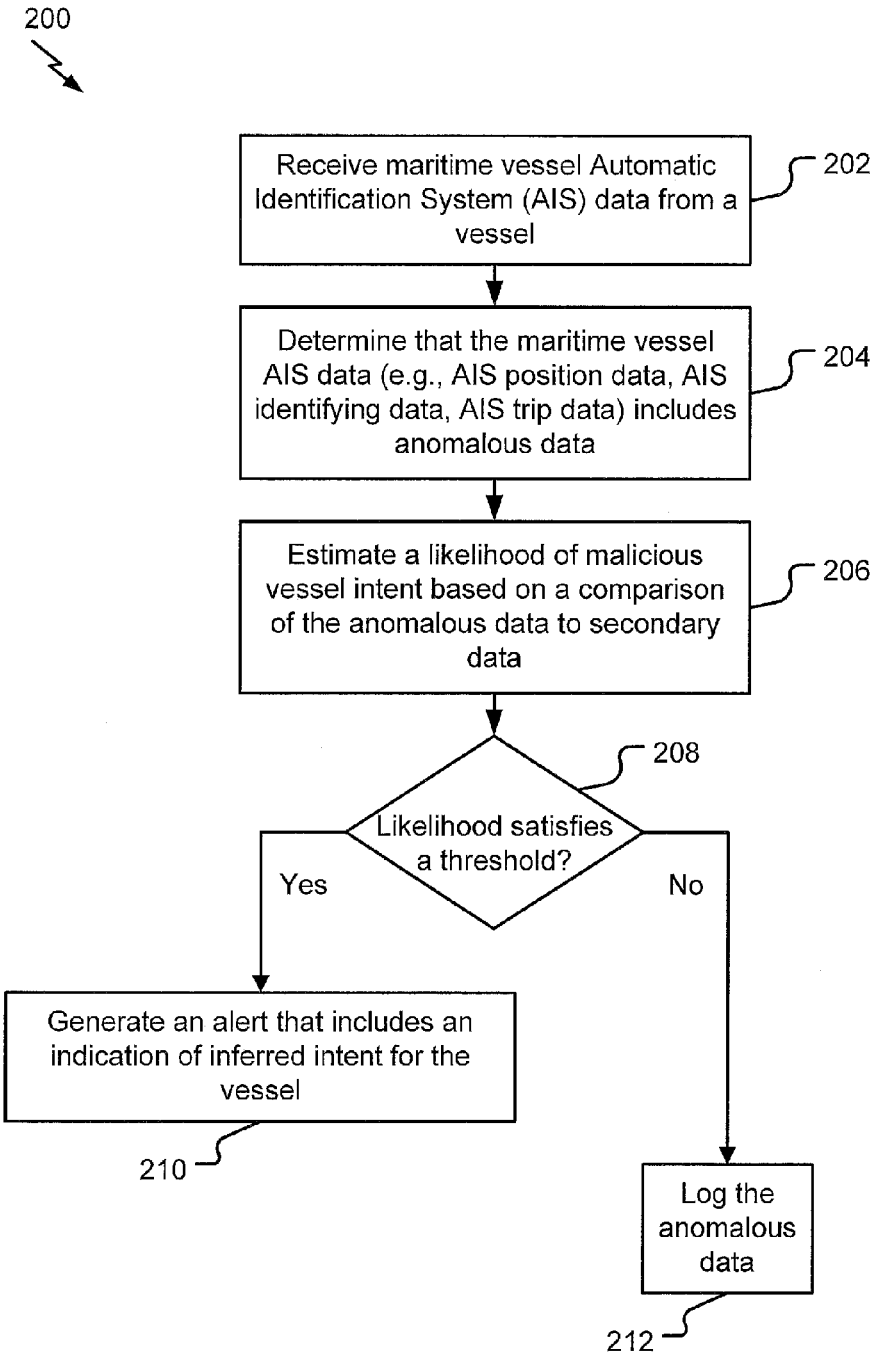
FIG. 2 is a flow chart illustrating a particular embodiment of a method of determining whether to generate an alert based on an estimated likelihood of malicious vessel intent.

FIG. 2 illustrates a particular embodiment of a method 200 of determining whether to generate an alert based on an estimated likelihood of anomalous AIS data being associated with malicious vessel intent. In the example of FIG. 2, anomalous data that satisfies a threshold for malicious vessel intent may result in an alert being generated, while other types of anomalous data may be logged (e.g., for historical purposes).

The method 200 includes receiving maritime vessel AIS data that is broadcast by a vessel, at 202. For example, referring to FIG. 1, the computing device 102 may receive the AIS data 130 that is broadcast by the first vessel 120. As explained further herein, the AIS data may include AIS position data, AIS identifying data, AIS trip data, or a combination thereof.

The method 200 includes determining that the maritime vessel AIS data includes anomalous data, at 204. For example, referring to FIG. 1, the computing device 102 may determine that the AIS data 130 includes anomalous data. As explained further herein, examples of anomalous data may include data that indicates a vessel position anomaly, a vessel identity anomaly, or a vessel trip anomaly (among other alternatives). The AIS data 130 may be compared to secondary data to determine whether the AIS data 130 includes anomalous data. To illustrate, the secondary data may include identity data, trip data, position data, or a combination thereof. For example, kinematic anomalies may be partially covered by position anomalies and partially covered by trip anomalies. As used herein, trip anomalies include anomalies such as crew composition (e.g., crew members inappropriate for a vessel or cargo type, frequency of crew change being higher than expected, etc.). Alternatively, additional categories and/or more granular categories may be utilized for classifying anomalies. Thus, categorization may represent a subjective process of defining a set of categories and/or hierarchy.

The method 200 includes estimating a likelihood of malicious vessel intent based on a comparison of the anomalous data to secondary data, at 206. For example, referring to FIG. 1, the computing device 102 may estimate a likelihood of malicious vessel intent based on a comparison of the anomalous data to secondary data (e.g., to one or more of the secondary data sources 132-136). In some cases, the secondary data may represent secondary position data, secondary vessel identity data, secondary vessel trip data, etc.

The method 200 includes determining whether the estimated likelihood of malicious vessel intent satisfies a threshold, at 208. If an anomaly is identified, the anomaly is included in hypothesis evaluations that increase the estimate of bad intent. Finding potential innocent explanations for the anomaly would be evidence against bad intent and would decrease the estimate of bad intent. For example, referring to FIG. 1, the computing device 102 may determine whether the estimated likelihood of malicious vessel intent satisfies the threshold 114.

In response to determining that the likelihood satisfies the threshold, the method 200 includes generating an alert, at 210. The alert includes an indication of an inferred intent for the vessel. The alert may include a configurable amount of information, potentially including the entire reasoning chain, with reference to all the pieces of evidence that led to a given conclusion, including quality estimates for each piece of evidence based on source and historical reliability of such types of information. More often, the alert contains a high level set of the most important conclusions reached (such as points both confirming and potentially disproving the hypothesis). Part of the information provided is the intent inferred regarding the vessel (e.g., does the vessel have potentially hostile intent or is the vessel engaged in innocuous activities. For example, referring to FIG. 1, the alert generation module 116 of the computing device 102 may generate the alert 140. While not shown in the example of FIG. 1, the alert 140 may include an indication (e.g., audio/video/haptic) of an inferred intent (or a category of inferred intent) for the first vessel 120.

In the particular embodiment illustrated in FIG. 2, the method 200 includes logging the anomalous data (without generating an alert) when the likelihood does not satisfy the threshold, at 212. Referring to the previous example of the local shipping company failing to change the MMSI setting when moving a radio between vessels, the problem may be logged with the shipping company. The Coast Guard may be made aware of the problem so that they can address the problem with the shipping company on a non-emergency basis. An example of historical data could be that the MMSI number is consistently wrong over time for a given vessel. This should be logged so that the incorrect MMSI number can be addressed at some point by the customer. By contrast, an MMSI number that is suddenly incorrect when the number is historically correct (or vice versa) may be more interesting since the sudden data anomaly does not have an associated innocent explanation. For example, referring to FIG. 1, the computing device 102 may store the anomalous data in the anomalous data log 117 in the memory 108 (e.g., in the case of a typographical error or a reasonable explanation). In some embodiments, the logged anomalous data becomes part of one of the secondary data sources.

Thus, FIG. 2 illustrates an example of a computer-based method of determining whether to generate an alert based on an estimated likelihood of anomalous AIS data being associated with malicious vessel intent. By utilizing secondary data for comparison to anomalous AIS data that is received from a vessel, anomalous data that is more likely to represent an actual threat may be identified. Filtering the anomalous data may allow maritime personnel to utilize limited resources for security operations (e.g., inspection/boarding/interception of a vessel).

Figure 3:
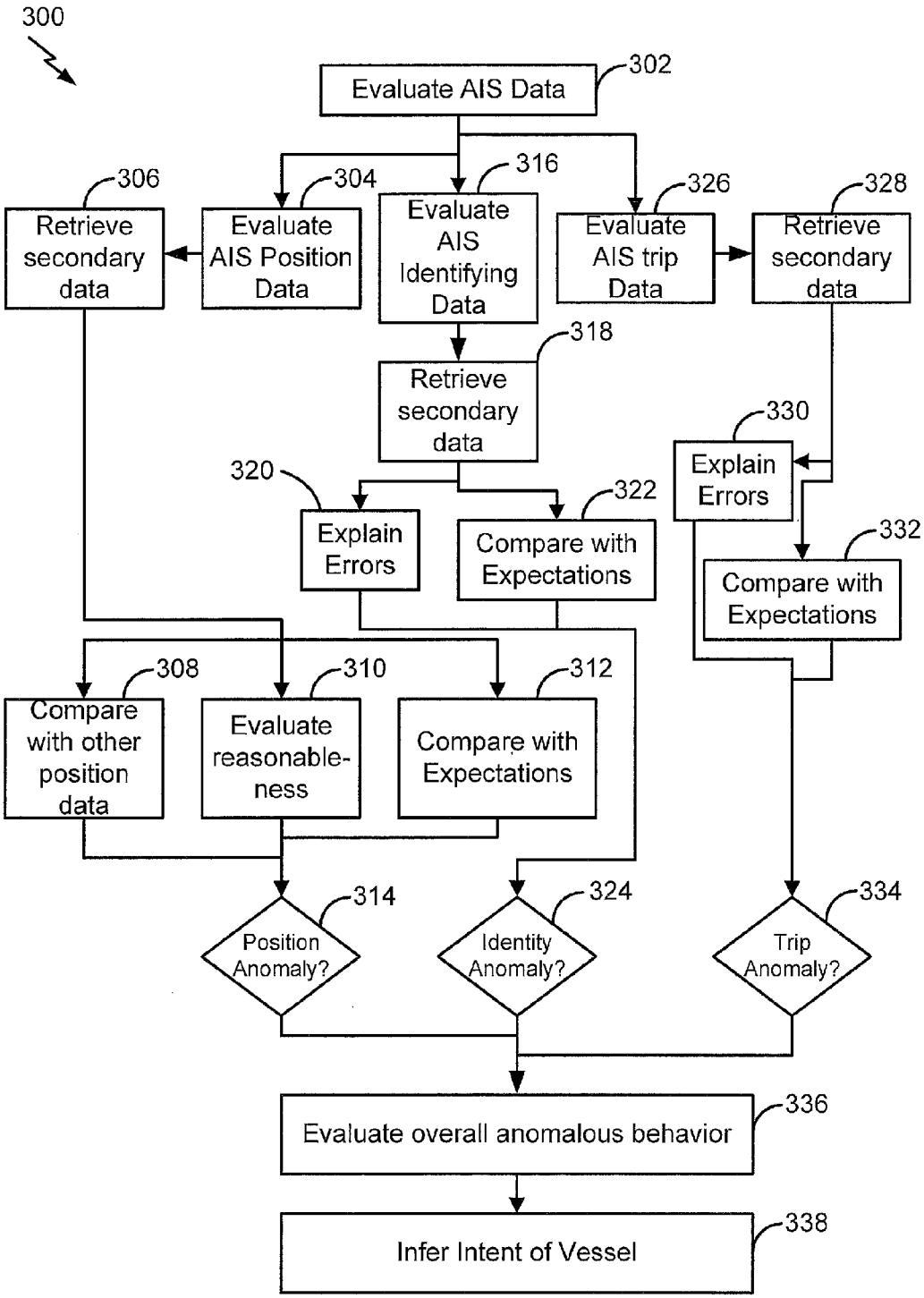
FIG. 3 is a flow chart illustrating another particular embodiment of a method of determining whether to generate an alert based on an estimated likelihood of malicious vessel intent.

FIG. 3 illustrates another particular embodiment of a method 300 of determining whether to generate an alert based on an estimated likelihood of anomalous AIS data being associated with malicious vessel intent. In the example of FIG. 3, the AIS data includes AIS position data, AIS identifying data, and AIS trip data. To determine whether anomalous AIS data is likely to represent malicious vessel intent, each type of AIS data may be separately evaluated, with a result of each evaluation being used to evaluate overall anomalous behavior. For example, anomalous AIS position data may be evaluated (based on secondary position data) to determine whether an anomalous vessel position anomaly exists. Anomalous AIS identifying data may be evaluated (based on secondary identifying data) to determine whether a vessel identity anomaly exists. Anomalous AIS trip data may be evaluated (based on secondary trip data) to determine whether a vessel trip anomaly exists.

The method 300 includes evaluating AIS data, at 302. FIG. 3 illustrates that evaluating the AIS data may include evaluating AIS position data, AIS identifying data, and AIS trip data. As an example, referring to FIG. 1, the AIS data analysis module 110 may evaluate the AIS data 130 received from the first vessel 120.

The method 300 includes evaluating the AIS position data, at 304. For example, referring to FIG. 1, the AIS data analysis module 110 may evaluate a portion of the AIS data 130 that corresponds to AIS position data.

The method 300 includes retrieving secondary position data, at 306. For example, referring to FIG. 1, the AIS data analysis module 110 may retrieve secondary position data from the first secondary data source 132.

The method 300 may include comparing with other position data (at 308), evaluating reasonableness (at 310), comparing with expectations (at 312), or a combination thereof.

The method 300 includes determining whether the AIS position data received from the vessel is indicative of a vessel position anomaly, at 314.

The method 300 includes evaluating the AIS identifying data, at 316. For example, referring to FIG. 1, the AIS data analysis module 110 may evaluate a portion of the AIS data 130 that corresponds to AIS identifying data.

The method 300 includes retrieving secondary identifying data, at 318. For example, referring to FIG. 1, the AIS data analysis module 110 may retrieve secondary identifying data from the second secondary data source 134.

The method 300 may include explaining errors (at 320), comparing with expectations (at 322), or a combination thereof.

The method 300 includes determining whether the AIS identifying data received from the vessel is indicative of a vessel identity anomaly, at 324.

The method 300 includes evaluating the AIS trip data, at 326. For example, referring to FIG. 1, the AIS data analysis module 110 may evaluate a portion of the AIS data 130 that corresponds to AIS trip data.

The method 300 includes retrieving secondary trip data, at 328. For example, referring to FIG. 1, the AIS data analysis module 110 may retrieve secondary trip data from the third secondary data source 136.

The method 300 may include explaining errors (at 330), comparing with expectations (at 332), or a combination thereof.

The method 300 includes determining whether the AIS trip data received from the vessel is indicative of a vessel trip anomaly, at 334.

The method 300 includes evaluating overall anomalous behavior, at 336. Different algorithmic methods may be used to calculate the likelihood value after all evidence is weighted and presented for the "preponderance of the evidence" calculations. In some cases, a simple average may be appropriate, while in other cases a more detailed analysis (e.g., Bayesian) may be appropriate when combining different evidence types. The overall anomalous behavior is determined by combining the results from the three areas of evaluation. A set of algorithms may be used, including heuristic, logical, and numerical algorithms, examples of which include simple averaging and Bayesian analysis. The evaluation of overall anomalous behavior may include an evaluation of a result of the vessel position anomaly determination (at 314), a result of the vessel identity anomaly determination (at 324), and a result of the trip anomaly determination (at 334). For example, referring to FIG. 1, the vessel intent likelihood estimation module 112 may evaluate the overall anomalous behavior that is associated with the AIS data 130 received from the first vessel 120.

The method 300 includes inferring an intent of the vessel, at 338. For example, the computing device 102 of FIG. 1 may infer an intent of the first vessel 120 based on an evaluation of the AIS data 130.

Thus, FIG. 3 illustrates an example of a method of determining whether to generate an alert based on an estimated likelihood of anomalous AIS data being associated with malicious vessel intent.

Figure 4:
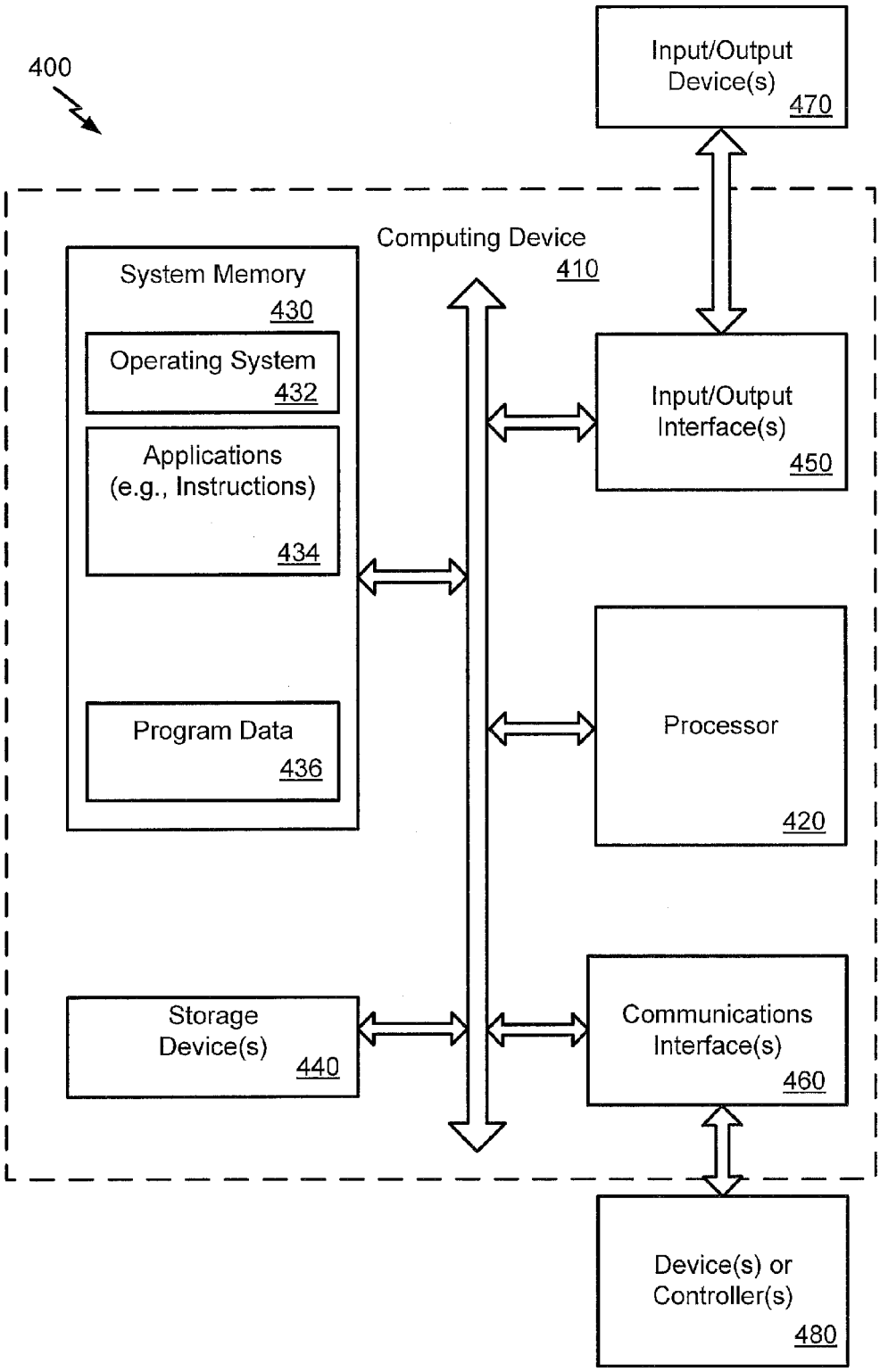
FIG. 4 is an illustration of a block diagram of a computing environment including a general purpose computing device configured to support embodiments of computer-implemented methods and computer-executable program instructions (or code) according to the present disclosure.

FIG. 4 is an illustration of a block diagram of a computing environment 400 including a general purpose computing device 410 configured to support embodiments of computer-implemented methods and computer-executable program instructions (or code) according to the present disclosure. The computing device 410, or portions thereof, may execute instructions according to any of the methods described herein. For example, the computing device 410 may execute instructions according to the methods 200 and 300 described with respect to FIG. 2 and FIG. 3, respectively.

The computing device 410 may include a processor 420. The processor 420 may communicate with the system memory 430, one or more storage devices 440, one or more input/output interfaces 450, one or more communications interfaces 460, or a combination thereof. The system memory 430 may include volatile memory devices (e.g., random access memory (RAM) devices), nonvolatile memory devices (e.g., read-only memory (ROM) devices, programmable read-only memory, and flash memory), or both. The system memory 430 may include an operating system 432, which may include a basic/input output system for booting the computing device 410 as well as a full operating system to enable the computing device 410 to interact with users, other programs, and other devices. The system memory 430 may include one or more applications 434 which may be executable by the processor 420. For example, the one or more applications 434 may include instructions executable by the processor 420 to perform various operations.

As an example, the application(s) 434 may include instructions executable by the processor 420 to receive maritime vessel AIS data that is broadcast by a vessel. The application(s) 434 may include instructions executable by the processor 420 to determine whether the maritime vessel AIS data includes anomalous data. The application(s) 434 may include instructions executable by the processor 420 to estimate a likelihood of malicious vessel intent based on a comparison of the anomalous data to secondary data. The application(s) 434 may include instructions executable by the processor 420 to generate an alert that includes an indication of an inferred intent for the vessel (in response to the likelihood of malicious vessel intent satisfying a threshold). In a particular embodiment, the application(s) 434 may include instructions executable by the processor 420 to refrain from generating the alert in response to the likelihood of malicious vessel intent failing to satisfy the threshold.

The processor 420 may also communicate with one or more storage devices 440. For example, the one or more storage devices 440 may include nonvolatile storage devices, such as magnetic disks, optical disks, or flash memory devices. The storage devices 440 may include both removable and non-removable memory devices. The storage devices 440 may be configured to store an operating system, images of operating systems, applications, and program data. In a particular embodiment, the memory 430, the storage devices 440, or both, include tangible computer-readable media.

The processor 420 may also communicate with one or more input/output interfaces 450 that enable the computing device 410 to communicate with one or more input/output devices 470 to facilitate user interaction. As an example, the computing device 410 may communicate with a display device to display the user interface 142 illustrated and described herein with respect to FIG. 1, among other alternatives. The processor 420 may detect interaction events based on user input received via the input/output interfaces 450. Additionally, the processor 420 may send a display to a display device via the input/output interfaces 450. The processor 420 may communicate with devices or controllers 480 via the one or more communications interfaces 460.

Embodiments described above are illustrative and do not limit the disclosure. It is to be understood that numerous modifications and variations are possible in accordance with the principles of the present disclosure.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it is to be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. A computer implemented method comprising:

receiving, at a computer, maritime vessel automatic identification system (AIS) data from a vessel;

determining that the maritime vessel AIS data includes anomalous data;

estimating a first likelihood of malicious vessel intent based on a comparison of the anomalous data to first data;

estimating a second likelihood that the anomalous data is associated with a typographical error by comparing an anomalous identifying parameter of the anomalous data to an expected identifying parameter to generate a matching percentage, and wherein the anomalous data corresponds to the typographical error responsive to the matching percentage failing to satisfy a threshold percentage of matching between the anomalous identifying parameter and the expected identifying parameter; and in response to the first likelihood of malicious vessel intent satisfying a threshold and in response to the second likelihood indicating that the anomalous data does not correspond to the typographical error, generating an alert that includes an indication of an inferred intent of the vessel.

2. The computer implemented method of claim 1, further comprising:

estimating a third likelihood of malicious vessel intent based on a comparison of the anomalous data to second data; and in response to the third likelihood of malicious vessel intent satisfying a second threshold and in response to the second likelihood indicating that the anomalous data does not correspond to the typographical error, generating a second alert that includes a second indication of a second inferred intent for the vessel, wherein the threshold is distinct from the second threshold.

3. The computer implemented method of claim 2, wherein the threshold is associated with an AIS spoofing attempt, wherein indication of the inferred intent corresponds with the AIS spoofing attempt, wherein the second threshold is associated with an AIS hijacking attempt, and wherein the second indication of the second inferred intent corresponds with the AIS hijacking attempt.

4. The computer implemented method of claim 1, wherein the indication of the inferred intent identifies a particular category of anomalous behavior of a plurality of categories of anomalous behavior.

5. The computer implemented method of claim 4, wherein the particular category of anomalous behavior corresponds to a vessel position anomaly category, a vessel identity anomaly category, or a vessel trip anomaly category.

6. The computer implemented method of claim 1, wherein the maritime vessel AIS data includes AIS position data, and further comprising determining that a vessel position anomaly is associated with the vessel based on a comparison of the AIS position data to secondary position data.

7. The computer implemented method of claim 6, wherein the vessel position anomaly is indicative of a deviation of the vessel from a shipping route.

8. The computer implemented method of claim 1, wherein the maritime vessel AIS data includes AIS identifying data, and further comprising determining that a vessel identity anomaly is associated with the vessel based on a comparison of the AIS identifying data to secondary vessel identity data.

9. The computer implemented method of claim 8, wherein the secondary vessel identity data includes a plurality of Maritime Mobile Service Identity (MMSI) numbers, and wherein the vessel identity anomaly is indicative of an incorrect MMSI number.

10. The computer implemented method of claim 8, wherein the secondary vessel identity data includes a plurality of International Maritime Organization (IMO) ship identification numbers, and wherein the vessel identity anomaly is indicative of an incorrect IMO ship identification number.

11. The computer implemented method of claim 1, wherein the maritime vessel AIS data includes AIS trip data, and further comprising determining that a vessel trip anomaly is associated with the vessel based on a comparison of the AIS trip data to secondary vessel trip data.

12. The computer implemented method of claim 11, wherein the AIS trip data includes an estimated time of arrival (ETA) at a destination, and wherein the vessel trip anomaly is indicative of a deviation of the ETA at the destination from an expected ETA at the destination.

13. The computer implemented method of claim 1, wherein the typographical error corresponds to a vessel name typographical error.

14. The computer implemented method of claim 10, wherein the typographical error corresponds to an IMO ship identification number typographical error.

15. A non-transitory computer-readable storage medium storing instructions that, when executed by a processor, cause the processor to perform operations comprising:

receiving maritime vessel automatic identification system (AIS) data from a vessel;

determining that the maritime vessel AIS data includes anomalous data;

estimating a first likelihood of malicious vessel intent based on a comparison of the anomalous data to first data;

estimating a second likelihood that the anomalous data is associated with a typographical error;

in response to the first likelihood of malicious vessel intent satisfying a threshold and in response to the second likelihood indicating that the anomalous data does not correspond to a typographical error, generating an alert that includes an indication of an inferred intent of the vessel;

estimating a third likelihood of malicious vessel intent based on a comparison of the anomalous data to second data; and in response to the third likelihood of malicious vessel intent satisfying a second threshold and in response to the second likelihood indicating that the anomalous data does not correspond to the typographical error, generating a second alert that includes a second indication of a second inferred intent for the vessel, wherein the threshold is distinct from the second threshold.

16. The non-transitory computer-readable storage medium of claim 15, wherein the anomalous data indicates a position on land.

17. The non-transitory computer-readable storage medium of claim 15, wherein the operations further include refraining from generating the alert in response to the first likelihood of malicious vessel intent failing to satisfy the threshold.

18. A system comprising:

a processor;

a memory in communication with the processor, the memory including instructions . executable by the processor to perform operations including:

receiving maritime vessel automatic identification system (AIS) data from a vessel;

determining that the maritime vessel AIS data includes anomalous data;

estimating a likelihood of malicious vessel intent based on a comparison of the anomalous data to first data;

estimating a second likelihood that the anomalous data is associated with a typographical error by comparing an anomalous identifying parameter of the anomalous data to an expected identifying parameter to generate a matching percentage, and wherein the anomalous data corresponds to the typographical error responsive to the matching percentage failing to satisfy a threshold percentage of matching between the anomalous identifying parameter and the expected identifying parameter; and in response to the likelihood of malicious vessel intent satisfying a threshold and in response to the second likelihood indicating that the anomalous data does not correspond to a typographical error, generating an alert that includes an indication of an inferred intent for the vessel.

19. The system of claim 18, wherein the first data includes weather data.

20. The computer implemented method of claim 1, further comprising, after estimating the first likelihood of malicious vessel intent, updating the first data to include a record of the anomalous data.

21. The non-transitory computer-readable storage medium of claim 15, wherein estimating the second likelihood that the anomalous data is associated with the typographical error includes comparing an anomalous identifying parameter of the anomalous data to an expected identifying parameter to generate a matching percentage, and wherein the anomalous data corresponds to the typographical error responsive to the matching percentage failing to satisfy a threshold percentage of matching between the anomalous identifying parameter and the expected identifying parameter.

22. The non-transitory computer-readable storage medium of claim 15, wherein the threshold is associated with an AIS availability disruption attempt.

* * * * *